United States Patent [19]

Matsuda

[11] Patent Number: 4,657,600

[45] Date of Patent: Apr. 14, 1987

[54] METHOD OF FORMING A CHEMICAL PHOSPHATE COATING ON THE SURFACE OF STEEL

[75] Inventor: Shigeki Matsuda, Okazaki, Japan

[73] Assignee: Nippondenso Co., Ltd., Kariya, Japan

[21] Appl. No.: 731,523

[22] Filed: May 7, 1985

[30] Foreign Application Priority Data

May 9, 1984 [JP] Japan ..... 59-93643

[51] Int. Cl.[4] ..... C23C 22/12

[52] U.S. Cl. ..... 148/6.15 R; 148/6.15 Z

[58] Field of Search ..... 148/6.15 R, 6.15 Z

[56] References Cited

U.S. PATENT DOCUMENTS 4,113,519 9/1978 Oka et al. ..... 148/6.15 Z
4,180,417 12/1979 Oka et al. ..... 148/6.15 Z
4,565,585 1/1986 Matsuda ..... 148/6.15 Z

FOREIGN PATENT DOCUMENTS 48-2097 1/1973 Japan .
59-110785 6/1984 Japan .
60-43491 4/1985 Japan .

*Primary Examiner*—Sam Silverberg
*Attorney, Agent, or Firm*—Cushman, Darby & Cushman

[57] ABSTRACT

A method of forming a chemical phosphate coating on the surface of steel with a treatment bath made without directly adding any oxidizing agent such as nitrite ions or hydrogen peroxide, and maintaining its temperature in a range not exceeding 40° C., its pH in the range of 2.5 to 4.5 and its oxidation-reduction potential (ORP in terms of the normal hydrogen electrode potential) in the range of 150 to 550 mV. The bath is formed from an aqueous solution of the two components, i.e. the first component, an acidic solution consisting mainly of oxo acid ions, such as, $NO_3^-$, phosphoric ions ($H_3PO_4$ or $H_2PO_4^-$), and metal ions, such as $Zn^{2+}$, and the second component, an alkaline solution containing hydroxide ions ($OH^-$). Preferably, the bath has a temperature of 20° C. to 30° C., a pH value of 3.0 to 4.0 and an ORP of 350 to 450 mV.

3 Claims, 5 Drawing Figures

METHOD OF FORMING A CHEMICAL PHOSPHATE COATING ON THE SURFACE OF STEEL

BACKGROUND OF THE INVENTION

1. Field of the Invention

This invention relates to a method of forming a chemical phosphate coating, such as of zinc phosphate, on the surface of steel.

2. Description of the Related Art

A chemical phosphate coating is used, for example, as an undercoat for rustproofing a steel plate or improving the adhesion of a paint thereto, or for improving the lubricating property of a frictionally slidable structural steel member. A chemical phosphate coating has hitherto been formed by employing a treatment bath having a temperature of at least 40° C. and supplying it with those quantities of a principal component containing phosphoric acid ions and zinc or other metal ions and an auxiliary component containing nitrite ions which are determined by the chemical volumetric analysis of the total acid, free acid and oxidizing agent in the bath with the aid of the worker's experience. It has, however, been difficult to control the bath properly even with the aid of the worker's experience, as the chemical volumetric analysis requires a lot of time and gives rise to a certain change, which is apparently due to an abnormal reaction, in the bath. It has been difficult to always form a coating of equally good quality which is, for example, useful for rustproofing a steel plate. These problems have been due to the fact that the reaction by which a phosphate coating is formed is not clear in detail and cannot, therefore, be controlled efficiently.

SUMMARY OF THE INVENTION

Therefore, the inventor of this invention has studied the reaction and had a new recognition as will hereinafter be set forth. As the bath has a high temperature (at least 40° C.), the components therein always have the energy which activates their reaction. Even a slight change in temperature, concentration, etc. affects the bath and causes the reactions between its components, such as (1) the formation of a sludge and (2) decomposition of the oxidizing agent, resulting in an unbalance between the components in the bath. This makes abnormal the reaction between the components in the bath and the steel to be treated, which is the most important reaction. In the process of chemical conversion phosphating, if the bath is held at an ambient temperature (20° C. to 30° C.), however, the stability of the components balance in the bath is maintained and the reaction takes place only between the bath components and the steel surface if certain conditions are satisfied. It is possible to control the reaction from an electrochemical standpoint, since the reaction occurs mainly as an electrochemical general corrosion reaction. The reaction occurs only when the steel surface contacts the bath. When the steel to be treated is not put into the bath, it remains stable and is, therefore, easy to control.

The method of this invention is characterized by employing a treatment bath receiving no oxidizing agent such as nitrite ions or hydrogen peroxide, and maintaining its temperature in a range not exceeding 40° C., its pH in the range of 2.5 to 4.5 and its oxidation-reduction potential (ORP in terms of the normal hydrogen electrode potential unless otherwise noted) in the range of 150 to 550 mV. The bath is formed from two components (agents) as will hereinafter be described. The first component is an acidic solution consisting mainly of $H_2PO_4^-$, ($H_3PO_4$), and oxo acid ions, such as $NO_3^-$, and metal ions, such as $Zn^{2+}$. It will hereinafter be called the principal component. The second component is an alkaline solution containing hydroxide ions ($OH^-$) and will hereinafter be called the auxiliary component. The bath is an aqueous solution of the principal and auxiliary components. According to this invention, the bath preferably has a temperature of 20° C. to 30° C., a pH value of 3.0 to 4.0 and an ORP of 350 to 450 mV.

According to this invention, no oxidizing agent, such as nitrite ions ($NO_2^-$), is used to prepare the bath or maintain its concentration, as opposed to the conventional method. This is an important feature of this invention. The term "oxidizing agent such as $NO_2^-$" as herein used means an agent which reacts very actively if added directly to the principal component, and exhibits so strong an oxidizing action that it cannot retain for a long time (at least an hour) the chemical formula representing it prior to its mixture with the principal component. Therefore, the oxo acid (e.g. $NO_3^-$) which can be mixed with the principal component beforehand is not an oxidizing agent in the context of this invention.

The zinc ions are not the only metal ions that the principal component can contain. It is equally possible to use manganese, calcium, magnesium or other metal which forms a hydrogenphosphate which is stable in an aqueous solution, and which shows a great reduction in solubility as a result of dehydrogenation as represented by formula (1):

$$xM(II)+y(H_2PO_4^-)\rightarrow Mx(PO_4)y+2yH^+ \quad (1)$$

According to this invention, the bath may further contain in its principal component nickel or like metal ions, other than zinc ions, as is usually the case with the bath employed by the conventional method.

The negative oxo acid ions which the principal component contains, such as $NO_3^-$ and $ClO_3^-$, serve to dissolve the film-forming constituents, such as $H_2PO_4^-$ and $Zn^{2+}$, in water in the bath and also promote a cathode reaction in the electrochemical reaction on the metal surface to thereby assist the formation of a coated film. The constituents of the auxiliary component undergo an electrochemical reaction with the oxo acid ions in the principal component to assist the formation of a coated film by the principal component.

This invention is characterized by the electrochemical general corrosion reaction which takes place on the steel surface to form a phosphate coating thereon. The electrochemical general corrosion reaction is featured by the simultaneous occurrence on the metal surface of an anode reaction (oxidizing reaction such as the melting of the metal) and a cathode reaction (reducing reaction). This reaction enables the uniform erosion (dissolving) of steel and the product of corrosion forms a uniform film on the steel surface to inhibit any further disolving of the steel when the composition of the negative ions, the concentration of components and other conditions are appropriately selected.

In case the oxo acid ions, the principal component, are $NO_3^-$, the anode reaction in the general corrosion reaction on the surface of steel is represented by formulas (2) to (4)

$$Fe\rightarrow Fe^{2+}+2e\ (-0.44\ V) \quad (2)$$

$$Fe^{2+} + H_2PO_4^- \rightarrow FePO_4 \downarrow + 2H^+ + e \quad (3)$$

$$3Zn^{2+} + 2H_2PO_4^- \rightarrow Zn_3(PO_4)_2 \downarrow + 4H^+ \quad (4)$$

and the cathode reaction by formula (5)

$$NO_2^- + 2H^+ + e \rightarrow NO \uparrow + H_2O \ (1.0\ V) \quad (5)$$

Although no $NO_2^-$ is supplied to the bath, the cathode reaction employs the $NO_2^-$ which is formed by the electrochemical reaction of $NO_3^-$, as shown by formulas (6) and (7), when the auxiliary component (alkali) is added to the bath. The potential (V) shown for each of reactions (2), (5), (6) and (7) is the potential of a normal hydrogen electrode (NHE).

Anode reaction:

$$4OH^- \rightarrow O_2 + 2H_2O + 4e \ (0.40\ V) \quad (6)$$

Cathode reaction:

$$NO_3^- + 2H^+ + 2e \rightarrow NO_2^- + H_2O \ (0.96\ V) \quad (7)$$

If the pH of the bath is maintained in the range of 2.5 to 4.5 and its ORP in the range of 150 to 550 mV, the reactions of formulas (6) and (7) take place electrochemically to form the $NO_2^-$ required for causing the reaction of formula (5) in the bath only when the auxiliary component is added to the bath. It is in a very small quantity (10 ppm or less) that the $NO_2^-$ ions formed by the reactions of formulas (6) and (7) stay free in the bath. This is obvious from the fact that no $N_2$ gas indicating the presence of free $NO_2^-$ is detected by a method which is widely employed for measuring the concentration of free $NO_2^-$ by using sulfamic acid. Therefore, the $NO_2^-$ ions formed by reactions (6) and (7) are believed to exist in the bath in a state other than free (i.e., forming a coordinate bond with metal ions).

The chemical reaction proceeds in a direction which brings about a reduction in the Gibbs free energy ($\Delta G$) of the whole reaction system.

Formulas (2) to (5) can be regarded as defining an electrochemical reaction system for forming a phosphate coating on the metal surface.

If the $\Delta G$ of the reaction system is reduced at an ambient temperature, it is possible to form a coating without applying any heat.

It has hitherto been impossible to have the phosphate coating forming reaction take place at an ambient temperature, since it has been impossible to control properly the reaction system defined by formulas (2) to (5). This invention enables the formation of a phosphate coating on the steel surface at an ambient temperature by controling the reaction, which is basically understood as an electrochemical reaction defined by formulas (2) to (5), in such a way that the reaction system may not contain any reaction inhibitor, such as sludge $Zn_3(PO_4)_2$.

Thus, this invention has, among others, the following three advantages:

(1) It enables the formation of a phosphate coating at an ambient temperature (not exceeding 40° C.);

(2) It enables the automatic control of the reaction for forming a phosphate coating; and (3) It enables the reaction, though no oxidizing agent, such as $NO_2^-$, is directly added to the bath.

The method of this invention employs a bath temperature of 0° C. to 40° C. for suppressing the nonelectrochemical (thermal) reaction which takes place in the bath according to the conventional method, and causing the electrochemical general corrosion reaction to form a chemical coating. The use of a high bath temperature, as by the conventional method, facilitates the progress of thermal decomposition reaction. When thermal energy has been supplied from an external source to a reaction system, the resulting chemical reaction is usually endothermic and increases the entropy ($\Delta S$) of the reaction system.

This results in a thermal decomposition reaction which forms hydrogen ions ($H^+$) and electrons (e) in the bath. The high temperature of the bath does not permit the hydrogen ions and electrons to exist separately from each other. It is, therefore, difficult to control electrochemically the reaction in a bath heated to a temperature of at least 40° C.

In addition to the electrochemical reactions of formulas (2) to (5), the thermal decomposition reactions of formulas (8) and (9) are considered to proceed actively in a hot phosphate treatment bath:

$$NO_2^- \rightarrow NO_2 \uparrow + e \quad (8)$$

$$H_3PO_4 \rightarrow H_2PO_4^- + H^+ \quad (9)$$

The reactions of formulas (8) and (9) cause the reactions (10) and (11) to take place in the bath:

$$H^+ + e \rightarrow \tfrac{1}{2}H_2 \uparrow \quad (10)$$

$$3Zn^{2+} + 2H_2PO_4^- + 4e \rightarrow Zn_3(PO_4)_2 \downarrow + 2H_2 \uparrow \quad (11)$$

In the hot bath, therefore, the reaction of formula (8) consumes nitrite ions and produces $NO_2$ gas and the reaction of formula (10) produces $H_2$ gas. The reaction of formula (11) produces sludge $Zn_3(PO_4)_2$. The components of the hot bath decompose themselves under heat and are consumed to form $NO_2$ gas, $H_2$ gas and sludge. An additional supply of the components is, therefore, required for the bath to form a phosphate coating.

The method of this invention makes it possible to inhibit the reactions of formulas (8) and (9), since the bath has a temperature not exceeding 40° C. and no oxidizing agent (free $NO_2^-$) is directly added to the bath. This enables the presence of stable positive and negative ions in the bath. It is further possible to suppress the reactions of formulas (10) and (11) and thereby reduce the generation of $H_2$ gas and sludge greatly.

The method of this invention, thus, restricts the inhibiting reactions and the formation of the inhibiting substances and permits the reactions of formulas (2) to (5) to take place only when the steel to be treated has been placed in the bath, thereby enabling them to proceed efficiently at an ambient temperature.

DETAILED DESCRIPTION OF THE INVENTION

Figure 1:
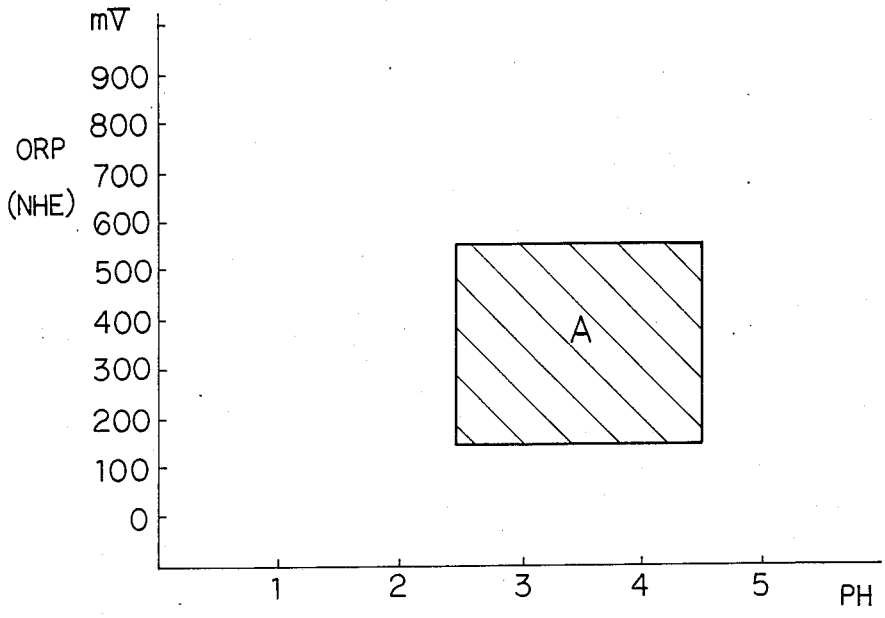
FIG. 1 is a graph showing the pH and oxidation-reduction potential ranges of the bath according to this invention.
Figure 2:
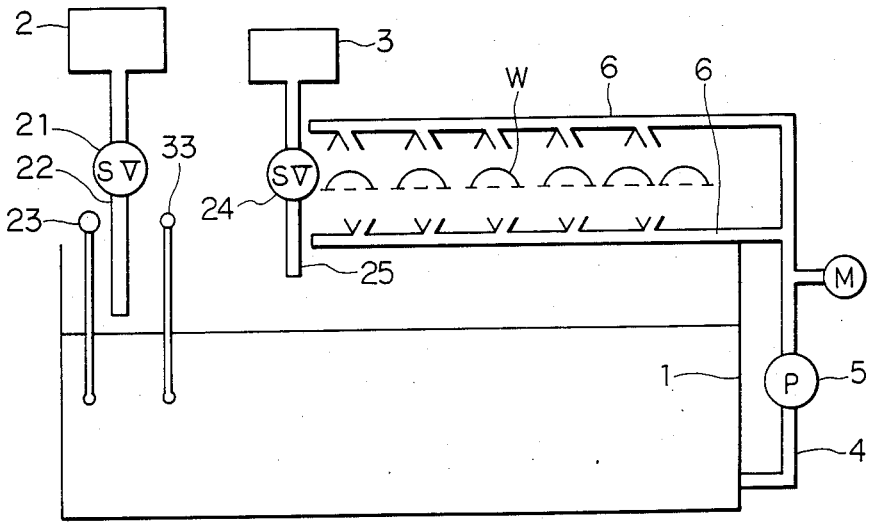
FIG. 2 is a schematic view of the apparatus used for carrying out this invention.

In order to enable the use of an ordinary production line for the phosphate coating forming reaction at an ambient temperature, it is necessary to employ a sufficiently high reaction rate. The factors affecting the rate of a chemical reaction at an electrode are (a) a sufficiently high concentration of the substances to be reacted, (b) a sufficiently low concentration of the substances inhibiting the reaction, (c) temperature, (d) pressure and (e) electrode potential. Although an increase in temperature accelerates the reaction, it is necessary to employ a low temperature in order to prevent the generation of gases inhibiting the reaction as shown by formulas (8), (10) and (11). In case treatment is effected by dipping, the pressure is usually maintained at an atmospheric level, but in the case of treatment by spraying, it is preferable to employ a somewhat higher pressure. As regards the concentration of the reaction substance for the dissolving reaction of iron represented by formula (2), it is preferable to employ both the oxidizing agent, such as $NO_2^-$, and the hydrogen ions at high concentrations, but for the film forming reaction of formulas (3) and (b 4), it is necessary to maintain the concentration of hydrogen ions at or below a certain level. As regards the electrode potential, it is necessary to ensure at least that the potential of reaction of the oxidizing agent (potential of the cathode reaction) be higher than the potential of dissolving reaction of steel (anode potential).

It follows that in order to cause the reaction for forming a phosphate coating on the steel surface to proceed electrochemically at a specific rate at a temperature of 0° C. to 40° C., it is necessary to:

(a) employ a combination of the material which dissolves at a sufficiently high speed at the ambient temperature and the bath; and (b) maintain the concentrations of the film forming agent, oxidizing agent, hydrogen ions and other reactants in the bath in a range enabling the formation of a phosphate film at the ambient temperature.

In case the material to be treated is steel, the requirement (a) is satisfied by a bath containing phosphoric acid ions, nitrate ions, zinc ions and the others as its principal component and an alkali, e.g. caustic soda, as its auxiliary component and having a pH range of 2.5 to 4.5 and an ORP range of 150 to 550 mV. The requirement (b) is satisfied by a bath (1) containing at least 2 g of phosphoric acid ions per liter, (2) having a sufficiently low sludge content and (3) having a pH range of 2.5 to 4.5 and an ORP range of 150 to 550 mV.

The addition of the auxiliary component containing $OH^-$, which is one of the salient features of this invention, is necessary for converting $NO_3^-$ to $NO_2^-$ in the bath. Insofar as a bath having an ambient temperature is hardly affected by thermal energy, it is more necessary to keep a proper balance of its components than in a high temperature bath. More specifically, it is necessary to keep a certain balance in the concentrations of $H_2PO_4^-$, $NO_3^-$, $Zn^{2+}$, $NO_2^-$, sludge $Zn_3(PO_4)_2$, etc. in the bath. The $H_2PO_4^-$ and $Zn^{2+}$ show a positive decrease with the formation of a film. This means a relative increase in $NO_3^-$ if the bath is used continuously at an ambient temperature. It is well known from experience that $NO_3^-$ interferes with the film forming reaction. It is, therefore, necessary to remove $NO_3^-$ from the bath by some method or other in order to keep a proper balance of the components in the bath. It is evident from basic chemistry that the increase in $NO_3^-$ alone raises the ORP of the bath and lowers its pH. According to this invention, the bath has an ORP range of 150 to 550 mV. If its ORP has increased, the auxiliary component (alkali) is added to the bath so that the anode reaction of formula (6) may take place to lower its ORP.

According to this invention, the bath has a pH range of 2.5 to 4.5. If the pH of the bath has exceeded a particular level between 2.5 and 4.5, the principal component, which is an acidic solution, is added to the bath, and if it has dropped below that level, the auxiliary component (alkali) is added to the bath, so that its pH may be maintained within the specific range. (The addition of the principal component raises the ORP of the bath.) The reaction of formula (6) is an anode reaction, while that of formula (7) is a cathode reaction, and the $NO_3^-$ ions in the bath are thereby converted to $NO_2^-$. The $NO_2^-$ ions are a strong "ligand" according to the chemistry of complex salts. As they form a coordinate bond with metal ions in the bath, its ORP and pH are both stable (free from any substantial fluctuation). The bath at an ambient temperature (not exceeding 40° C.) is, therefore, stable. The of formula (7), etc. removes $NO_3^-$ from a bath having a high temperature (40° C. or above), as from a bath at an ambient temperature. This is, however, not as a result of electrochemical reaction, but mainly due to a reduction in the heat content ($\Delta H$) of the reaction system. The alkali which can be used as the auxiliary component is not only sodium or potassium hydroxide, but also sodium carbonate or any other salt that forms an alkaline aqueous solution. It is also possible to use $ZnO_2^{2-}$. The appropriate addition of the alkali to the bath causes the removal of $NO_3^-$ therefrom with the addition of $OH^-$ as shown by formulas (6) and (7). The excessive addition of $OH^-$, however, results not only in the removal of $NO_3^-$, but also in the reaction of $OH^-$ with $H_2PO_4^-$ forming sludge as shown by the following formula:

$$3Zn^{2+} + 2H_2PO_4^- + 4OH^- \rightarrow Zn_3(PO_4)_2 \downarrow + 4H_2O \quad (12)$$

The pH and ORP of the bath change in accordance with formula (12). Its pH increases and its ORP decreases, whereby the sludge is formed in the bath and inhibits the formation of a film. According to the method of this invention, however, the supply of the principal agent (acidic solution) and the auxiliary component (alkali) is controlled automatically in accordance with pH and ORP control as hereinabove described. Therefore, no sludge is formed in the bath, but it is maintained in proper conditions for forming a coating on the steel surface.

The method disclosed in a prior patent application (No. 152150/1983) enables the film forming reaction even in the presence of a large amount of sludge. It, however, involves the addition of free $NO_2^-$ to the bath and differs from the method of this invention which does not involve the addition of free $NO_2^-$.

The method of this invention employs a wider pH range, though a narrower ORP range, than that of patent application No. 152150/1983. A brief discussion of these differences will hereinafter be made. The narrower ORP range is due to the fact that the method of this invention does not use free $NO_2^-$. The ORP of the bath is affected more easily by the presence of free radicals than by any other factor. According to the method of this invention, the bath hardly contains any free $NO_2^-$ and its ORP can, therefore, be kept in a low and narrow range. This invention enables a higher and wider pH range than the method of patent application No. 152150/1983. This is also due to the absence of free $NO_2^-$ in the bath. In a pH range of 3.5 and above, the solubility of the 'phosphoric acid-zinc compound' shows not a small reduction resulting in a relative increase of the sludge of zinc phosphate [$Zn_3(PO_4)_2$] (and still more at a high temperature). At an ambient temperature and if $NO_2^-$ forms a coordinate bond with metal, however, metal (mainly zinc) ions, dihydrogen-phosphate ions ($H_2PO_4^-$) and $NO_2^-$ form a complex salt having a higher degree of solubility. It is, therefore, possible to prepare a bath containing a relatively large quantity of $H_2PO_4^-$ and $Zn^{2+}$ which are reactive even at a pH level of 3.5 or above. Although the method of patent application No. 152150/1983 is also carried out at an ambient temperature, the addition of free $NO_2^-$ to the bath results in the formation of a large amount of sludge in the bath, as opposed to the method of this invention, and thereby the inhibition of the film forming reaction.

The conventional high temperature bath has usually a pH range of 3.0 to 3.4 if it is used for treatment by spraying, or a pH range of 1.0 to 3.0 if it is used for dipping treatment. According to the method of this invention, the bath temperature not exceeding 40° C. makes it difficult for sludge to form in the bath and the reactions of formulas (3) and (4) take place mainly on the steel surface. This enables the bath to have a wider pH range of 2.5 to 4.5. If its pH is lower than 2.5, the film forming reactions of formulas (3) and (4) are restricted. If the temperature of a phosphate treatment bath is lowered when its pH and ORP are measured, a change occurs to the equilibrium reactions in the bath, as is obvious from, for example, an increase in 'free acid concentration'. This change gives the results of measurement which differ from what would be obtained if the temperature were not lowered. The pH and ORP values appearing in this specification are those obtained at the temperature at which the bath is used.

The bath employed by the method of this invention has an ORP range of 150 to 550 mV. It is low as compared with the oxidation-reduction potential of about 500 mV or higher of the bath which has hitherto been used at a high temperature. The high ORP of the conventional bath is apparently due to the synergism of two factors, i.e., that the self-decomposition of the bath components is promoted by heat and necessitates the constant supply of a large amount of oxidizing agent in addition to the principal component such as phosphoric acid, and that the bath is held at a high temperature. It is also true that the presence of a large amount of sludge of zinc phosphate, from which the coating is also formed, makes it necessary to provide a large force for promoting the film forming reaction on the steel surface. It is, therefore, necessary to heat the bath and add a large amount of oxidizing agent, such as free $NO_2^-$, as well as the principal component (acidic solution), to promote the reaction. These factors raise the ORP of the bath.

According to the method of this invention, it is possible to promote the electrochemical film-forming reaction with an ideally high degree of efficiency in a wider pH range and a lower oxidation-reduction potential range (not exceeding 550 mV) than those of the conventional bath, since the bath is substantially free from any sludge and has a low temperature, and since no oxidizing agent, such as $NO_2^-$, is added directly to the bath.

FIG. 1 shows the pH and oxidation-reduction potential ranges of the bath which is employed by this invention. The rectangle marked "A" in FIG. 1 indicates the pH and ORP ranges defined by this invention.

Iron and steel are the metal materials which can be treated by the method of this invention. The term "iron and steel" does not simply mean ordinary iron and steel, but also covers alloy steel and surface-treated steel such as galvanized steel plate. According to the method of this invention, the concentration control of the bath can be effected automatically in accordance with the results of measurement of its pH and ORP, as the film forming reaction proceeds electrochemically. If steel is placed in the bath, its principal component ($H_2PO_4^-$, $Zn^{2+}$ and $NO_2^-$ forming a coordinate bond with $Zn^{2+}$) reacts with the steel and is removed from the bath by forming a coating on the steel. The pH and ORP of the bath are correlated to the concentration of the principal component. As the $H_2PO_4^-$ and $Zn^{2+}$ in the principal component are consumed for the film forming reaction, the bath now contains a relatively large amount of $NO_3^-$. Accordingly, the pH of the bath decreases and its ORP increases. If the auxiliary component (alkali) is added to the bath, the reactions of formulas (6) and (7) take place to convert $NO_3^-$ to $NO_2^-$ ($NO_2^-$ forming a coordinate bond) to thereby raise the pH of the bath and lower its ORP.

Thus, it is convenient to adapt a valve for supplying the principal component so that it may, for example, open when the pH of the bath has risen above 3.2 and close when it has dropped below 3.2. (It is also effective to add the auxiliary component (alkali) to the bath when its pH has dropped.)

The supply of the auxiliary component can likewise be controlled. It is, for example, effective to adapt a valve for supplying it so that it may open when the oxidation-reduction potential of the bath has risen above 430 mV and close when it has dropped below 430 mV. Both of the pH and ORP are very easy to determine electrically without requiring any chemical analysis. It is, therefore, easy to realize the automatic control of the bath. Examples of the bath are a bath containing the principal component A [3800 mg/l of $Zn^{2+}$, 10,000 mg/l of $H_2PO_4^-$, 2600 mg/l of $NO_3^-$ (containing $NO_2^-$ forming a coordinate bond), 10 to 15 mg/l of $Ni^{2+}$, etc.] and having a pH range of 3.0 to 3.4, and a bath containing the principal component B [1600 mg/l of $Zn^{2+}$, 4800 mg/l of $H_2PO_4^-$, 960 mg/l of $NO_3^-$ (containing $NO_2^-$ forming a coordinate bond), 4 to 5 mg/l of $Ni^{2+}$, etc.] and having a pH range of 3.8 to 4.1.

When the principal component is supplied to the bath, it is appropriate to supply a concentrated solution having a concentration which is 10 to 40 times higher than what has hereinabove been set forth. The auxiliary component may be an aqueous solution containing 1 to 10% by weight of sodium hydroxide (NaOH) and added to the bath containing the principal component A or B.

The phosphate coating obtained by the method of this invention is higher in density than the coating formed by the conventional method. The higher density means the improved corrosion resistance of the paint applied to the coating and the improved stretchability of the coating during, for example, cold forming. The excellent coating owes itself to a reason which can be explained by the experience relating to the electrochemical reaction taking place on the metal surface which is, for example, plated. It is known from experience that an increase in the overvoltage of the metal (electrode) surface gives a higher density and a higher stability to the electrodeposit (coating) formed thereon if the anions in the solution are of the same composition and concentration. It is also known that the overvoltage of the metal surface shows a sharp reduction with a rise in temperature, and that a rise in temperature results in a less stable coating having a coarser crystal structure. These facts are believed to explain the high density and stability of the coating obtained by the method of this invention which employs a lower bath temperature than the conventional method and, therefore, forms the coating on the metal surface having a high overvoltage.

The method of this invention is superior to the conventional method not only in the density and stability of the phosphate coating which it forms, but also in the ease of bath control and even its automatic control, since it enables the bath control based on the measurement of its pH and oxidation-reduction potential. Moreover, it employs a bath at an ambient temperature not exceeding 40° C. and does not require the heating of the bath, as opposed to the conventional method. This means a reduction in the consumption of energy. Moreover, it enables a reduction in the self-decomposition of the bath components and thereby the efficient use thereof. It reduces to a half or less the quantity of the bath components which has hitherto been required. This enables a drastic reduction in the sludge formed in the bath. The method of this invention can be carried out by a simpler apparatus, as it does not require any settling tank that has been essential for the conventional bath.

EXAMPLES

The invention will now be described by way of example.

Figure 3:
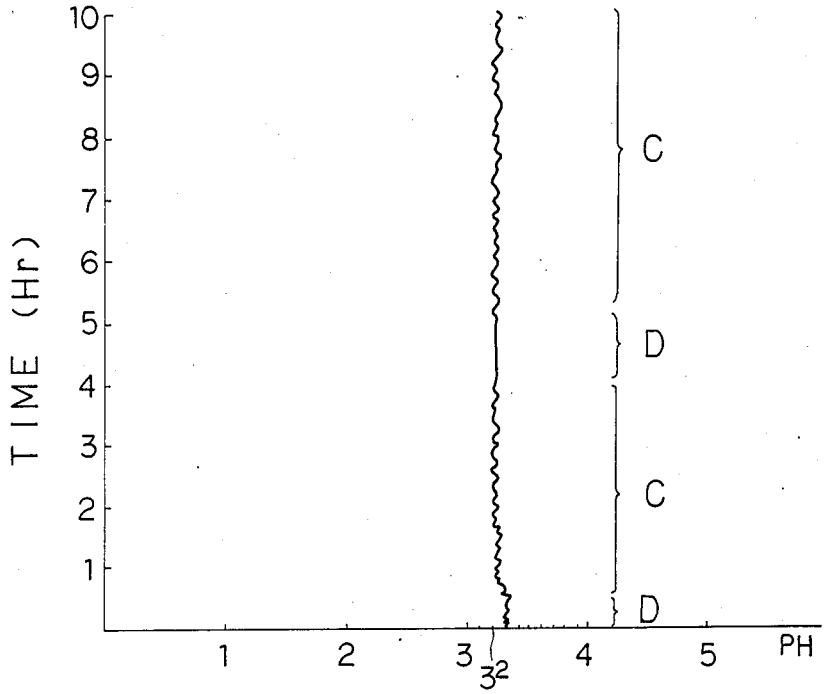
FIG. 3 is a chart showing the record of the pH value obtained as a result of automatic control according to the method of this invention.

A principal component supply pipe 22 extending from a principal component tank 2 and having a solenoid valve 21 and an auxiliary component supply pipe 25 extending from an auxiliary component tank 3 and having a solenoid valve 24 were connected to a treatment tank 1 holding 0.8 $m^3$ of a bath containing 3800 mg/l of zinc ions, 10,000 mg/l of phosphoric acid ions, 2600 mg/l of nitric acid ions (containing $NO_2^-$ forming a coordinate bond) and 10 to 15 mg/l of nickel, as shown schematically in FIG. 3. The solenoid valves 21 and 24 were electrically connected to each other by an electric circuit (not shown) adapted for opening or closing by a pH meter 23 and an oxidation-reduction potential meter 33, which were immersed in the bath, so that the valve 21 might open to supply the principal component from the tank 2 to the tank 1 with an increase in the pH of the bath to 3.2 or above and close with a drop in the pH of the bath to 3.2 or below, and so that the valve 24 might open and supply the auxiliary component from the tank 3 to the tank 1 with a drop in the pH of the bath to below 3.2 and close with its rise to 3.2 or above. The solenoid valve 24 was also adapted to open and supply the auxiliary component from the tank 3 to the tank 1 if the oxidation-reduction potential meter (silver chloride electrode) 33 indicated a potential of 230 mV or above (AgCl electrode potential), and close if it indicated a potential of 230 mV or below (AgCl electrode potential). A spray pipe 4 was provided on the sidewall of the tank 1 and connected through a pump 5 to two vertically spaced apart rows 6 of spray nozzles disposed above the tank 1 to spray the bath against the surface of the work-piece W. The principal component used for replenishing purposes was an acidic aqueous solution supplying 1.4 g of zinc, 4.0 g of phosphoric acid, 0.8 g of nitric acid and 0.05 g of nickel per minute, and the auxiliary component was an aqueous solution supplying 0.14 g of $OH^-$ per minute. The work-piece was a pulley for an AC generator for an automobile made by press forming cold rolled steel plate or cutting casting steel (FC-15) and having a diameter of about 6 to 9 cm.

The work was degreased by spraying an aqueous alkali solution at 55° C. for two minutes, washed in water at 45° C. for 0.5 minute, washed by spraying water at an ambient temperature (20° C. to 30° C.) for 0.5 minute, subjected to phosphate coating treatment by spraying the bath at an ambient temperature (20° C. to 30° C.) for two minutes by the apparatus of FIG. 3, washed by spraying water at an ambient temperature for 0.5 minute, washed by spraying water at an ambient temperature for 0.5 minute and dried by hot air at 80° C. to 90° C. for two minutes, whereby a phosphate coating consisting mainly of zinc phosphate was formed on the work-piece surface. Two thousand pieces of work were treated per hour by this apparatus, while the bath was controlled fully automatically. The treatment was continued for 100 days and nothing abnormal was found in the bath.

Figure 4:
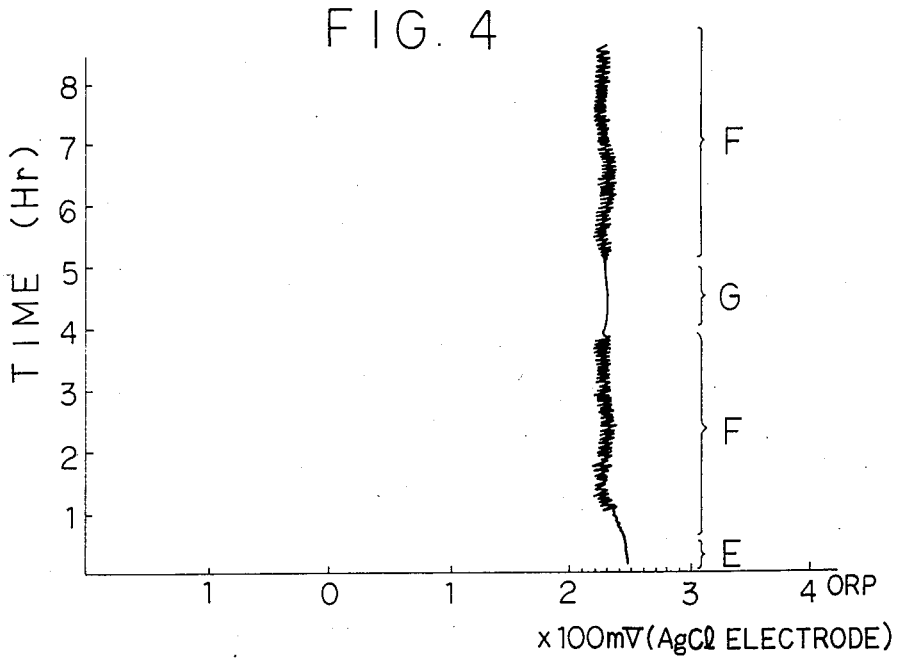
FIG. 4 is a chart showing the record of the ORP value obtained as a result of automatic control according to the method of this invention.

The records of automatic control of the bath are shown in FIGS. 3 and 4. A BHC-76-6045 pH electrode and an HBR-92 controlling recorder, which were the products of Denkikagaku Keiki K.K., were used for controlling the pH of the bath. FIG. 3 is a typical representation of a part of the pH recorder. In FIG. 3, the abscissas denote the pH value and the ordinates denote time. The ordinates are graduated in hours. The area marked [C] in FIG. 3 represents the records of control achieved by supplying the principal component when the pH of the bath rose to 3.2 or above and discontinuing its supply when the pH dropped to 3.2 or below. The pH values were always 3.2 or higher despite the constant supply of the principal component consisting of an acidic solution, because the ORP control of the bath maintained a constant supply of the auxiliary component (sodium hydroxide solution) in the bath by adding it if the pH of the bath dropped below 3.2. Although a constant supply of the principal component was maintained for the bath, its pH remained unchanged as shown in FIG. 3 and its composition also remained unchanged as shown in TABLE 1 below. (The bath was used for treatment for 16 hours a day.) The bath was at a temperature of 23° C. to 35° C.

TABLE 1

| | After 1 day | After 2 days | After 3 days |
|---|---|---|---|
| Total acid | 16.6 pt | 15.5 | 14.6 |
| Free acid | 0.6 pt | 0.7 | 0.8 |
| Zinc ions | 3.8 g/l | 3.6 | 3.6 |
| Nickel ions | 12.7 mg/l | 11.9 | 10.2 |
| Phosphoric acid ions | 10.4 g/l | 9.9 | 9.5 |

TABLE 1-continued

| | | | |
|---|---|---|---|
| Sodium ions | 0.7 g/l | 0.6 | 0.6 |
| Nitric acid ions (containing $NO_2^-$ forming a coordinate bond) | 2.6 g/l | 2.7 | 2.7 |
| Free $NO_2^-$ | 10 ppm or less | 10 ppm or less | 10 ppm or less |
| | After 4 days | After 5 days | After 6 days |
| Total acid | 15.9 pt | 14.0 | 15.5 |
| Free acid | 0.8 pt | 0.7 | 0.7 |
| Zinc ions | 3.7 g/l | 3.3 | 3.7 |
| Nickel ions | 9.9 mg/l | 9.4 | 9.8 |
| Phosphoric acid ions | 9.8 g/l | 9.0 | 9.9 |
| Sodium ions | 0.6 g/l | 0.6 | 0.7 |
| Nitric acid ions (containing $NO_2$ forming a coordinate bond) | 2.7 g/l | 2.4 | 2.5 |
| Free $NO_2^-$ | 10 ppm or less | 10 ppm or less | 10 ppm or less |
| | After 7 days | After 8 days | |
| Total acid | 15.1 pt | 15.9 | |
| Free acid | 0.6 pt | 0.7 | |
| Zinc ions | 3.5 g/l | 3.7 | |
| Nickel ions | 9.0 mg/l | 9.6 | |
| Phosphoric acid ions | 9.2 g/l | 9.1 | |
| Sodium ions | 0.7 g/l | 0.7 | |
| Nitric acid ions (containing $NO_2$ forming a coordinate bond) | 2.1 g/l | 2.4 | |
| Free $NO_2^-$ | 10 ppm or less | 10 ppm or less | |

The pH of the bath did not show any appreciable change irrespective of the presence of the steel to be treated therein. This is obviously due to the fact that the ions in the bath, such as $Zn^{2+}$, $H_2PO_4^-$ and $NO_2^-$, formed coordinate bonds with one another, as hereinbefore stated. (The ratio of $NO_3^-$ to $NO_2^-$ forming a coordinate bond is not clear, nor is its clarification required.) The pH range shown at [D] in FIG. 3 is of the bath in which no steel was present, and hardly differs from the range shown at [C].

FIG. 4 shows a part of the ORP recorder. The abscissas denote the oxidation-reduction potential and the ordinates denote time. The ordinates are graduated in hours. A BHC-76-6026 metal electrode (silver chloride electrode) and an HBR-94 controlling recorder, which were the products of Denkikagaku Keiki K.K., were used for controlling the ORP. The silver chloride electrode is of the type which is widely used, and its potential is converted to the potential of a normal hydrogen electrode by formula (13):

$$E(NHE)=E(\mathrm{AgCl})+206-0.7(t-2.5)\ \mathrm{mV} \quad (13)$$

where

E(NHE): Potential of a normal hydrogen electrode

E(AgCl): 3.33 MKCl=Potential of AgCl electrode t: Temperature (°C.).

The pH and ORP values herein shown are those as measured at the temperature at which the bath was used, as hereinbefore stated, and do not take the temperature coefficient of formula (13) into consideration.

Figure 5:
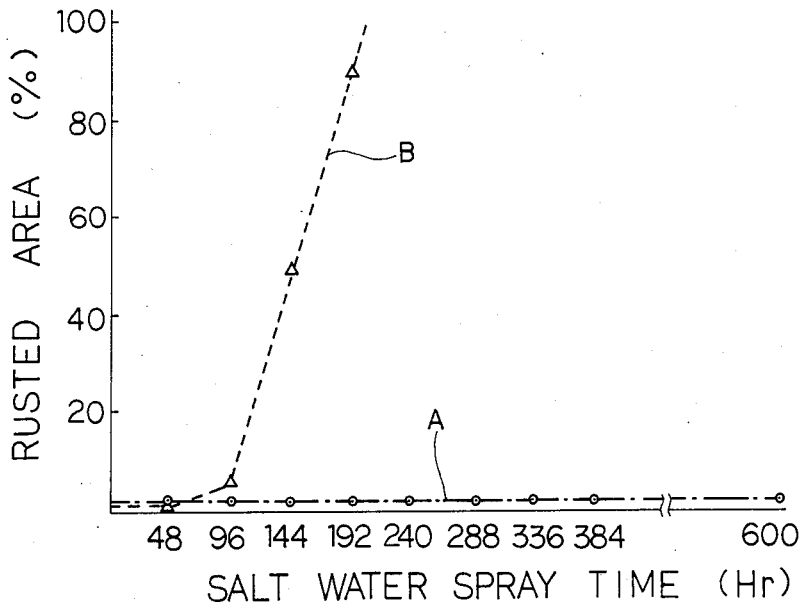
FIG. 5 is a graph comparing the materials treated by the method of this invention and by the conventional method with respect to the rusted area in relation to the salt water spray time.

The results shown at [E] in FIG. 5 are those which were obtained during the beginning of operation before the material to be treated (steel) was placed in the bath. The ORP values of the bath were, however, only slightly higher than the results which were obtained after the material to be treated had been placed in the bath, and which are shown at [F].

The small difference between the ORP values shown at [E] and [F] is attributable to the coordinate linkage of the ions in the bath. The coordinate linkage of $NO_2^-$ and other ions prevents the ORP of the bath from rising to such a high level (700 mV or above) as it would show if they ($NO_2^-$ and the other) existed independently of each other. The results shown at [E] and [F] were all obtained when the supply of the auxiliary component (alkali) was automatically controlled in accordance with the ORP of the bath. More specifically, the auxiliary component (alkali) was supplied to the bath when its ORP had risen to a level of 230 mV or above (AgCl electrode potential), and its supply was discontinued when the ORP had dropped to 230 mV or below (AgCl electrode potential). As a result, the ORP of the bath was maintained in the range of 230±10 mV (AgCl electrode potential).

The stability of the potential shown at [G] was due to the interruption of supply of the material to be treated (steel). It returned to the state shown at [F] when the supply of the material was started again.

The method of this invention enables the fully automatic electrochemical control of the bath as hereinabove described. It is, however, necessary to prevent any electrochemical reaction between the bath and the material of the treatment tank. It is, therefore, desirable to make the tank of highly insulated construction (for example, by lining it with rubber).

A black urethane-epoxy resin paint was sprayed onto the material on which a phosphate coating had been formed as hereinabove described. The paint was allowed to set for three minutes and baked for six minutes in a baking furnace having a temperature of 180° C. to yield a coated film having a thickness of 8 to 12μ. A salt spray test was conducted in accordance with the procedure of JIS k-5400-7.8 to examine the corrosion resistance of the coated film. The results are shown in FIG. 5. Curve A in FIG. 5 shows the rusted area of the coated material treated according to the method of this invention in relation to the salt spray time. Curve B shows the results obtained on the coated material treated according to the conventional method. The material on which the phosphate coating had been formed by the method of this invention showed a drastic improvement in corrosion resistance over the material which had been treated with the conventional bath having a high temperature exceeding 40° C. (i.e. having a temperature of 50° C. to 55° C., a pH range of 3.1 to 3.3 and an ORP range of 730 to 750 mV, its principal component being equal in composition to that of the bath employed by the method of this invention).

What is claimed is:

1. A method for providing a phosphate coating on a succession of steel articles, comprising:

(a) constituting a treatment bath by introducing a principal and an auxiliary bath component into a bath container, wherein:

(i) said principal bath component is an acidic aqueous solution consisting mainly of $H_2PO_4^-$, oxo acid ions and metal ions; and (ii) said auxiliary bath component is an aqueous alkaline solution containing hydroxide ions, the relative concentrations of said principal and auxiliary bath components being such that at a temperature in the range of 0° C. to 40° C., said treatment bath has a pH range of 2.5 to 4.5 and an ORP range, in terms of normal hydrogen electrode potential, of 150 to 550 mV, said treatment bath containing at least 2 g of phosphoric ions per liter and no more than 10 ppm free $NO_2^-$;

(b) wetting an exposed surface of each of a succession of steel articles with said treatment bath within said temperature range in order to generate a phosphate coating on said exposed surface of each said steel article, (c) while conducting said wetting, (i) monitoring the pH of said treatment bath and adding more of said principal component thereto in order to maintain the pH of said treatment bath lowered to within said pH range, (ii) monitoring the ORP of said treatment bath and adding more of said auxiliary component thereto in order to maintain the ORP of said treatment bath lowered to within said ORP range, (iii) without adding to said treatment bath either for constituting said treatment bath or for maintaining said pH or ORP thereof any oxidizing agent which reacts within one hour if added to said principal component so as to fail to retain the chemical formula which represented such oxidizing agent prior to its mixture with said principal component.

2. The method of claim 1, wherein:

said temperature range is 20° C. to 30° C., said pH range is 3.0 to 4.0 and said ORP range is 350 to 450 mV.

3. The method of claim 2, wherein:

said oxo acid ions include at least one of $NO_3^-$ ions and $ClO_3^-$ ions; and said metal ions include those of at least one of zinc, manganese, calcium, magnesium, nickel and a metal which forms a hydrogen phosphate which is stable in an aqueous solution and which is capable of showing a substantial reduction in solubility as a result of dehydrogenation.

* * * * *